US009323174B2

(12) United States Patent
Kato

(10) Patent No.: US 9,323,174 B2
(45) Date of Patent: Apr. 26, 2016

(54) IMAGE FORMING APPARATUS

(75) Inventor: Shuichi Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 285 days.

(21) Appl. No.: 13/600,721

(22) Filed: Aug. 31, 2012

(65) Prior Publication Data

US 2013/0051853 A1 Feb. 28, 2013

(30) Foreign Application Priority Data

Aug. 31, 2011 (JP) ..... 2011-188487

(51) Int. Cl.

| | |
|---|---|
| ***G03G 15/04*** | (2006.01) |
| ***G03G 15/08*** | (2006.01) |
| ***G03G 15/01*** | (2006.01) |
| ***G03G 21/16*** | (2006.01) |

(52) U.S. Cl.

CPC ..... *G03G 15/0813* (2013.01); *G03G 15/0189* (2013.01); *G03G 21/1671* (2013.01); *G03G 21/1676* (2013.01)

(58) Field of Classification Search

CPC ..... G03G 15/0813; G03G 21/1671; G03G 21/1676

USPC ..... 399/119

See application file for complete search history.

(56) References Cited

U.S. PATENT DOCUMENTS

| | | | |
|---|---|---|---|
| 6,157,797 | A | 12/2000 | Saito et al. |
| 7,656,496 | B2 | 2/2010 | Kim et al. |
| 8,107,855 | B2 | 1/2012 | Nishimura et al. |
| 8,467,703 | B2 | 6/2013 | Nishimura et al. |
| 8,744,308 | B2 | 6/2014 | Nishimura et al. |

(Continued)

FOREIGN PATENT DOCUMENTS

| | | | |
|---|---|---|---|
| JP | 04172476 A | * | 6/1992 |
| JP | 11-295952 A | | 10/1999 |

(Continued)

OTHER PUBLICATIONS

Jun. 9, 2015—(JP) Notice of Reasons for Rejection—App 2011-188487.

*Primary Examiner* — David Gray
*Assistant Examiner* — Thomas Giampaolo, II
(74) *Attorney, Agent, or Firm* — Banner & Witcoff, Ltd.

(57) ABSTRACT

An image forming apparatus includes: a photosensitive body on which an electrostatic latent image is formed; a developing cartridge arranged below the photosensitive body and having a developing roller configured to supply a developing agent to the photosensitive body and to be rotatable about an rotation shaft of the developing roller; a support body configured to removably support the developing cartridge; and a pressing member configured to press the rotation shaft of the developing roller so as to press the developing roller against the photosensitive body.

11 Claims, 8 Drawing Sheets

(56) References Cited

U.S. PATENT DOCUMENTS

| | | | | |
|---|---|---|---|---|
| 9,075,343 | B2 | 7/2015 | Nishimura et al. | |
| 2004/0174426 | A1 | 9/2004 | Nomura et al. | |
| 2005/0243262 | A1 | 11/2005 | Kim et al. | |
| 2006/0067734 | A1* | 3/2006 | Igarashi et al. | 399/119 |
| 2009/0245859 | A1* | 10/2009 | Okabe | 399/117 |
| 2009/0317133 | A1 | 12/2009 | Nishimura et al. | |
| 2009/0324283 | A1* | 12/2009 | Mushika et al. | 399/119 |
| 2010/0135694 | A1 | 6/2010 | Hashimoto et al. | |
| 2010/0209140 | A1* | 8/2010 | Kamimura et al. | 399/111 |
| 2010/0239329 | A1* | 9/2010 | Kitani et al. | 399/285 |
| 2012/0107015 | A1 | 5/2012 | Nishimura et al. | |
| 2012/0328329 | A1 | 12/2012 | Sato et al. | |
| 2013/0266342 | A1 | 10/2013 | Nishimura et al. | |
| 2014/0270850 | A1 | 9/2014 | Nishimura et al. | |

FOREIGN PATENT DOCUMENTS

| | | | |
|---|---|---|---|
| JP | 2003-195648 | A | 7/2003 |
| JP | 2003-205647 | A | 7/2003 |
| JP | 2003-207965 | A | 7/2003 |
| JP | 2004-109455 | A | 4/2004 |
| JP | 2005-316375 | A | 11/2005 |
| JP | 2009-181002 | A | 8/2009 |
| JP | 2010-008511 | A | 1/2010 |
| JP | 2010-128342 | A | 6/2010 |
| JP | 2010-224085 | A | 10/2010 |
| JP | 2013-007945 | A | 1/2013 |

* cited by examiner

IMAGE FORMING APPARATUS

CROSS REFERENCE TO RELATED APPLICATION

The present application claims priority from Japanese Patent Application No. 2011-188487 filed on Aug. 31, 2011 the disclosure of which is incorporated herein by reference in its entirety.

BACKGROUND OF THE INVENTION

1. Field of the Invention

The present invention relates to an image forming apparatus having a developing roller pressed toward or against a photosensitive body.

2. Description of the Related Art

Conventionally, there is known an image forming apparatus including a photosensitive drum and a developing cartridge arranged over or above the photosensitive drum and having a developing roller for supplying a toner to the photosensitive drum. In this technique, a boss is provided on a housing of the developing cartridge arranged above the developing roller; and when the boss is pressed downwardly with a pressing member, the developing roller arranged below the developing cartridge is pressed against the photosensitive drum.

In this technique, the developing roller is arranged to be oriented downwardly, and thus not only the pressing force of the pressing member but also the self weight of the developing cartridge contribute to bring the developing roller into pressurized contact with the photosensitive drum, thereby making it possible to stably press the developing roller against the photosensitive drum. Note that the term "the developing roller is arranged to be oriented downwardly (upwardly)" means that the developing roller is arranged or located such that a portion, of the developing roller, which faces the photosensitive body such as the photosensitive drum extends downwardly (upwardly).

SUMMARY OF THE INVENTION

However, in a case that the developing cartridge as described above is arranged below the photosensitive drum in a state that the developing roller extends upwardly, the boss which is located away from and at a location lower than the developing roller needs to be urged upwardly. Accordingly, there is a fear that the pressing force pressing the developing roller against the photosensitive drum might lean or offset in the axis direction of each of the developing roller and the photosensitive drum.

In view of the above situation, an object of the present teaching is to provide an image forming apparatus including a developing cartridge having a developing roller arranged to be oriented upwardly, the image forming apparatus being capable of pressing the developing roller against a photosensitive body such as a photosensitive drum with respect to the axis direction of the developing roller, in a well-balanced manner.

According to an aspect of the present teaching, there is provided an image forming apparatus configured to form an image on a sheet-shaped medium, including:

a photosensitive body on which an electrostatic latent image is formed;

a developing cartridge arranged below the photosensitive body and having a developing roller configured to supply a developing agent to the photosensitive body and to be rotatable about a rotation shaft of the developing roller;

a support body configured to removably support the developing cartridge; and a pressing member configured to press the rotation shaft of the developing roller so as to press the developing roller against the photosensitive body.

Here, the term "arranged below the photosensitive body" means that the rotation shaft of the developing roller is arranged at a position below the rotation shaft of the photosensitive body. Further, the term "rotation shaft of the developing roller" encompasses also an axis portion which is provided to be coaxial with the rotation shaft of the developing roller.

According to this construction, the rotation shaft of the developing roller extending upwardly or the axis portion being coaxial with the rotation shaft is pressed by the pressing member. Thus, it is possible to press the developing roller against the photosensitive body in the axis direction and in a well-balanced manner as compared with the construction in which a portion, of the developing roller, that is located below the rotation shaft of the developing roller is pressed.

DESCRIPTION OF THE PREFERRED EMBODIMENTS

Next, a detailed explanation will be made about a color printer as an example of the image forming apparatus according to an embodiment of the present teaching, with reference to the drawings appropriately. Note that in the following explanation, the directions are defined based on directions seen from a user when using the color printer. Namely, in FIG. 1, the right side on the sheet surface is defined as "front"; the left side on the sheet surface is defined as "rear"; in a direction perpendicular to the sheet surface, the front side on the sheet surface is defined as "left" and the far side on the sheet surface is defined as "right". Further, in FIG. 1, the up/down direction in the sheet surface is defined as "up" and "down", respectively.

Figure 1:
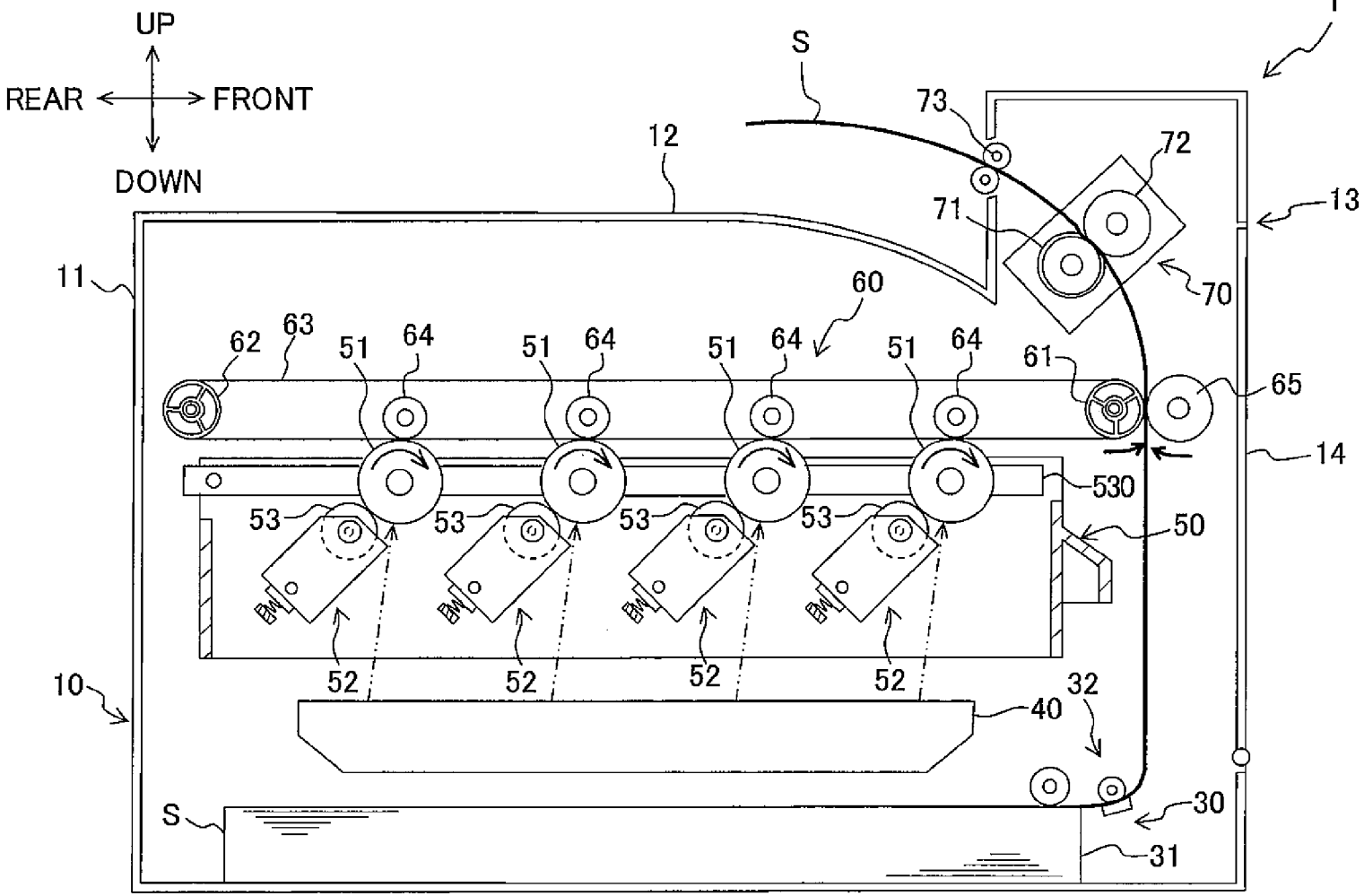
FIG. 1 is an explanatory view showing a color printer as an example of image forming apparatus.

As shown in FIG. 1, a color printer 1 includes a paper feeding unit 30, a scanner unit 40, a drawer 50, a transfer unit 60 and a fixing unit 70 in an apparatus body 10 of the color printer 1.

The apparatus body 10 has a paper discharge tray 12 configured to accommodate paper sheets S, at an upper portion of the apparatus body 10. Further, an opening 13 through which the drawer 50 is pulled out of or removed from the apparatus body 10, is formed in a front wall portion of the apparatus body 10; and a front cover 14 for opening/closing the opening 13 is pivotably provided on the apparatus body 10.

The paper feeding unit 30 is arranged in the apparatus body 10 at the lower portion of the apparatus body 10, and includes a paper feeding tray 31 configured to accommodate the paper sheets S and a paper sheet supply mechanism 32 configured to transport the paper sheets S from the paper feeding tray 31 to a transfer position. Here, the transfer position is located between an intermediate transfer belt 63 and a secondary transfer roller 65. The paper sheets S in the paper feeding tray 31 are separated one by one by the paper sheet supply mechanism 32 and are each transported to the transfer position.

The scanner unit 40 is arranged above or over the paper feeding unit 30 and includes an un-illustrated laser beam emitting section, an un-illustrated polygon mirror, an un-illustrated lens, an un-illustrated reflecting mirror, etc. Further, in the scanner unit 40, a laser beam passes or travels in a route indicated by two-dot chain line in 1 and the laser beam is irradiated on a surface of a photosensitive drum 51, as an example of the photosensitive body, such that the laser beam is subjected to scanning at high speed.

Figure 2:
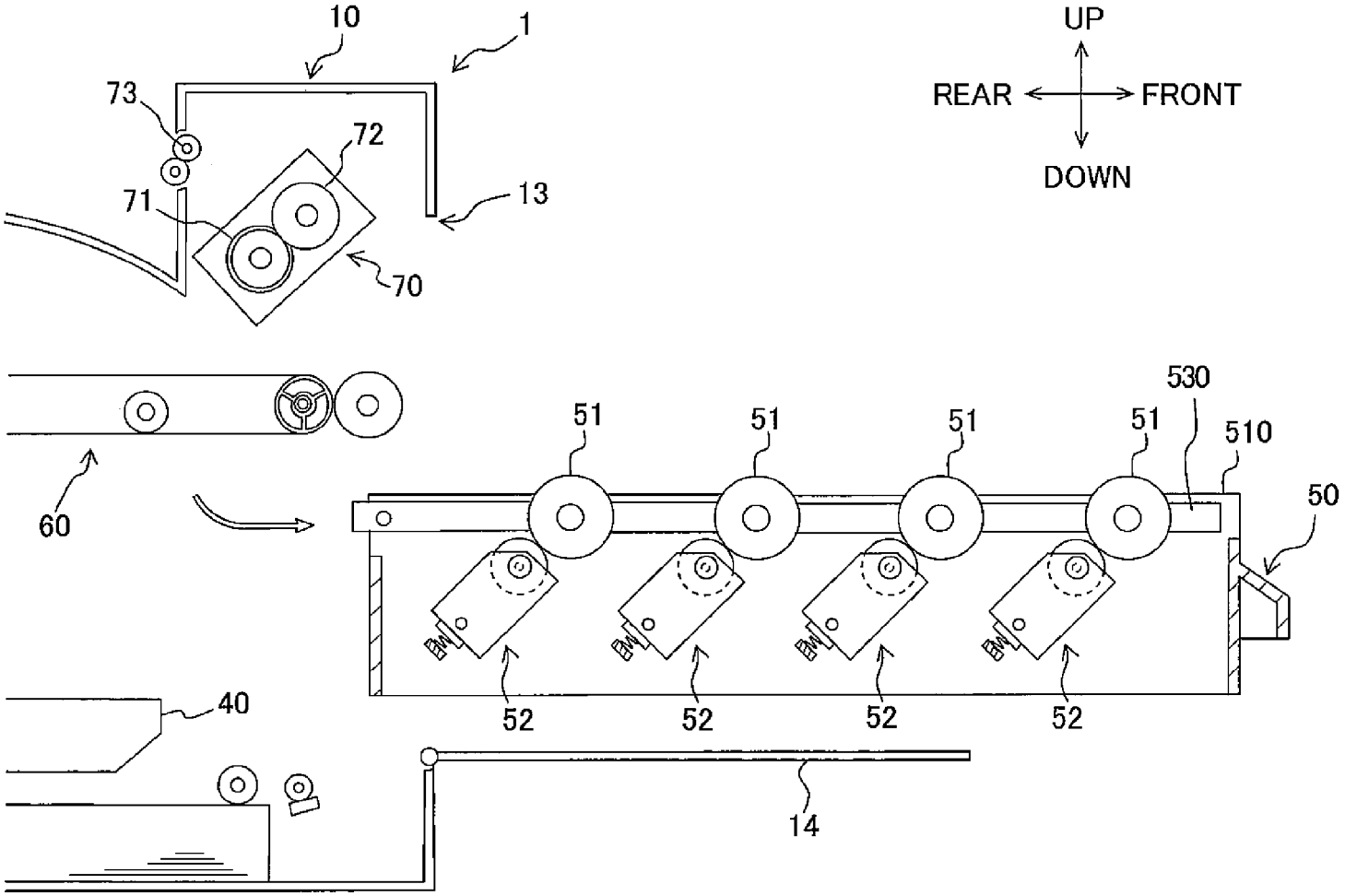
FIG. 2 is an explanatory view showing a state that a drawer is pulled out from an apparatus body of the printer.

The drawer 50 is arranged at a position below or under the intermediate transfer belt 63, to be located between the intermediate transfer belt 63 and the scanner unit 40; and the drawer 50 is supported to be movable with respect to the apparatus body 10 in a substantially front/rear direction, and is capable of being pulled out frontward from the opening 13 of the apparatus body 10, as shown in FIG. 2. Specifically, the drawer 50 is supported by un-illustrated rails. The rails extend in the front/rear direction and of which rear end portion extends rearward and obliquely upward so that the drawer 50 is separated away from the intermediate transfer belt 63 when the drawer 50 is pulled out from the apparatus body 10.

In the drawer 50, four pieces of the photosensitive drum 51, four un-illustrated publicly known chargers and four developing cartridges 52 are arranged; and each of the developing cartridges 52 includes a developing roller 53, an un-illustrated publicly known supply roller, an un-illustrated publicly known layer-thickness regulating blade, an un-illustrated publicly known tonner accommodating chamber, etc. Each of the developing cartridges 52 is arranged at a position at which the developing roller 53 extends upward and the rotation shaft of the developing roller 53 is located below or under the rotation shaft of one of the photosensitive drums 51. The constructions of the drawer 50 and the developing cartridges 52 will be described in detail later on.

The transfer unit 60 is arranged above the drawer 50, and includes a driving roller 61, a driven roller 62, the intermediate transfer belt 63 which is an endless belt stretched between the driving roller 61 and the driven roller 62, four primary transfer rollers 64 arranged to face the photosensitive drums 51 respectively via the intermediate transfer belt 63, and a secondary transfer belt 65 arranged to face the driving roller 61 via the intermediate transfer belt 63.

In the drawer 50 and the transfer unit 60 described above, at first, the surface of each of the photosensitive drums 51 is uniformly charged by the charger, and then is exposed by the scanner unit 40. With this, an electrostatic latent image based on an image data is formed on each of the photosensitive drums 51. Further, the tonner in the tonner accommodating chamber is held on the surface of the developing roller 53 via the supply roller.

The tonner held on the surface of the developing roller 53 is supplied from the developing roller 53 to the electrostatic latent image on each of the photosensitive drums 51. With this, the electrostatic latent image is visualized and an image of the tonner (tonner image) is formed and held on each of the photosensitive drums 51. Tonner images of respective colors formed on the photosensitive drums 51, respectively, are successively overlaid and transferred on the intermediate transfer belt 63. Further, when paper sheet S transported from the paper feeding unit 30 is made to pass the transfer position between the intermediate transfer belt 63 and the secondary transfer roller 65, the tonner images formed on the intermediate transfer belt 63 are transferred onto the paper sheet S.

The fixing device 70 is arranged to be located in front of and above the transfer unit 60, and includes a heating roller 71, a pressure roller 72 arranged to face the heating roller 71 and configured to press the heating roller 71, and a discharge roller 73 configured to discharge the paper sheet S on which the tonner images are fixed to the outside of the apparatus body 10, in the fixing device 70, the paper sheet S on which the toner images are fixed is made to pass between the heating roller 71 and the pressure roller 72 to thereby thermally fix the toner images on the paper sheet S, and the paper sheet S is discharged by the discharge roller 73 to the outside of the apparatus body 10 and is placed on the paper discharge tray 12.

<Construction of Drawer 50 and Developing Cartridge 52>

Figure 3:
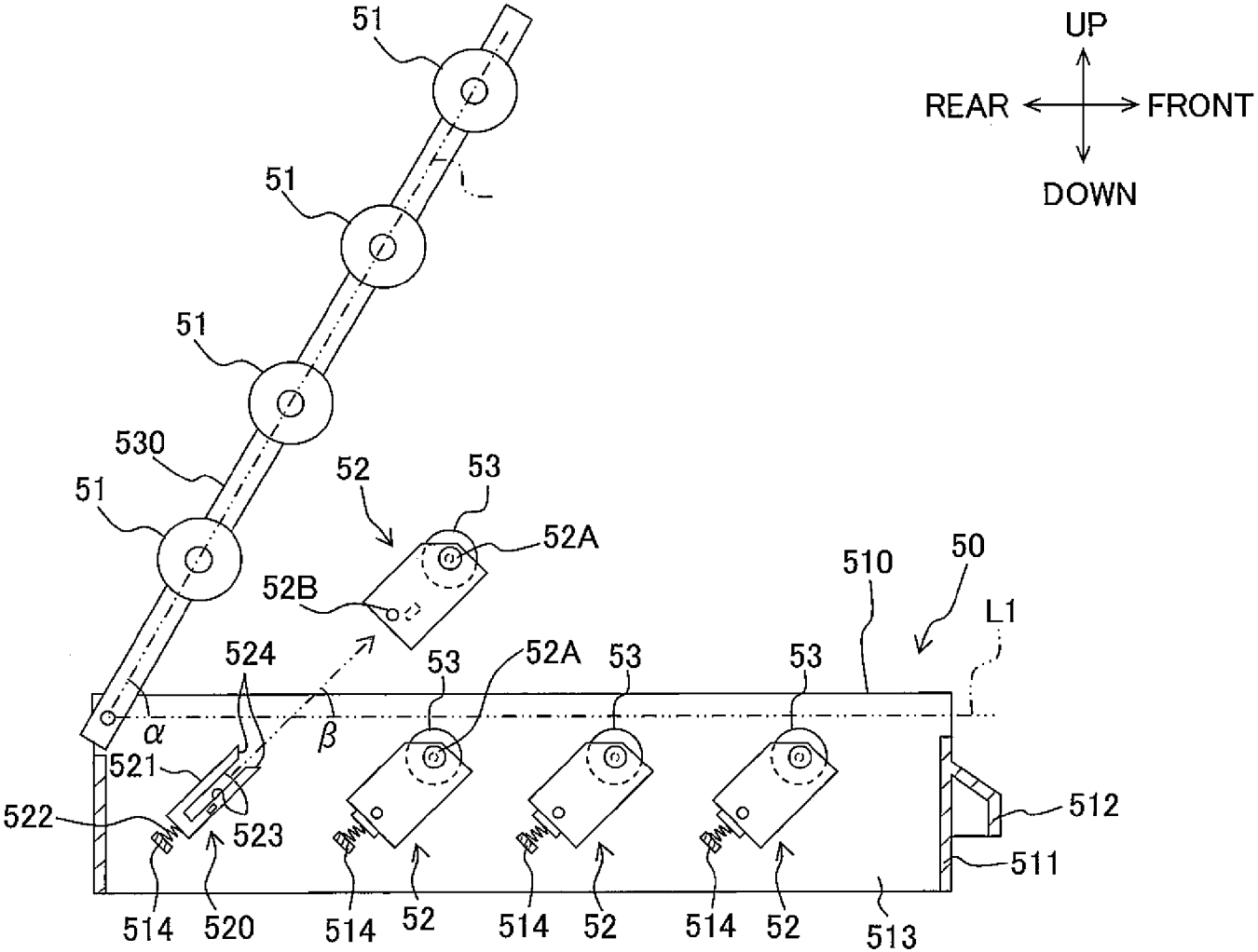
FIG. 3 is an explanatory view showing a state that a photosensitive body support member is pivoted upwardly.

As shown in FIG. 3, the drawer 50 includes a support body 510 configured to removably (detachably) support the developing cartridges 52, four pressure members 520 configured to press the developing rollers 53 against the photosensitive drums 51, respectively, and a photosensitive body-support member 530 configured to rotatably support the four photosensitive drums 51.

The support body 510 is formed to have a rectangular box shape which is hollow and is open in the upper and lower portions thereof, and has a front wall 511 and a handle 512 which is provided on the front wall 511 and which is grasped by a user. Further, four projections 514 are provided on each of left and right side walls 513 of the support body 510 to project inwardly in the left/right direction, namely project toward the inside of the support body 510, so that the projections 514 support the respective pressing members 520.

The pressing members 520 are each configured to press axis portions 52A which are coaxial with the rotation shaft of the developing roller 53 upwardly (specifically, obliquely upwards and frontwards) to thereby press the developing rollers 53 against the photosensitive drums 51, respectively. Here, the axis portions 52A are formed to have a columnar shape projecting, from the left and right side walls of the developing cartridge 52, outwardly in the left/right direction.

With this, the axis portions 52A which are coaxial with the rotation shaft of each of the developing rollers 53 which are oriented upwardly are pressed upwardly by one of the pressure members 520, thereby making it possible to press each of the developing rollers 53 against one of the photosensitive drums 51 in the axial direction and in a well-balanced manner as compared with a construction in which a portion, of each of the developing cartridges, located below the rotation shaft of each of the developing rollers.

Specifically, each of the pressing members 520 includes a guide member 521 configured to guide one of the developing cartridges 52 to an install position, and a coil spring 522 as an example of an urging member configured to urge the guide member 521 toward the photosensitive drum 51. Here, the term "install position" means a position at which the developing roller 53 extends upwardly and is capable of making contact with the photosensitive drum 51 (position indicated in FIG. 3).

Figure 4A:
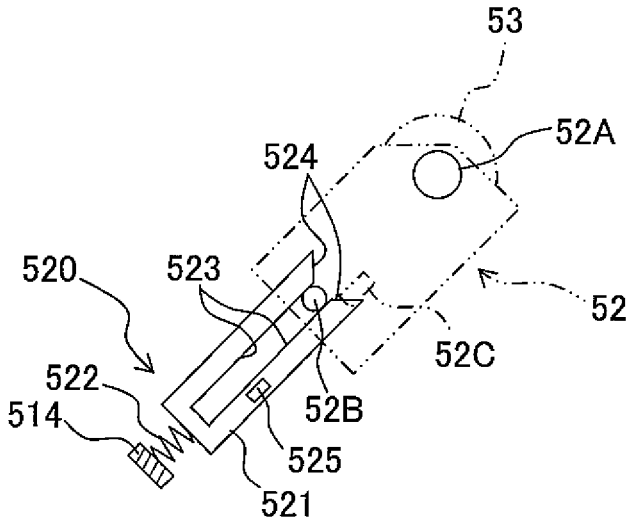
FIGS. 4A to 4C are explanatory views showing movement of respective parts or components until the developing cartridge is installed in the drawer.
Figure 4B:
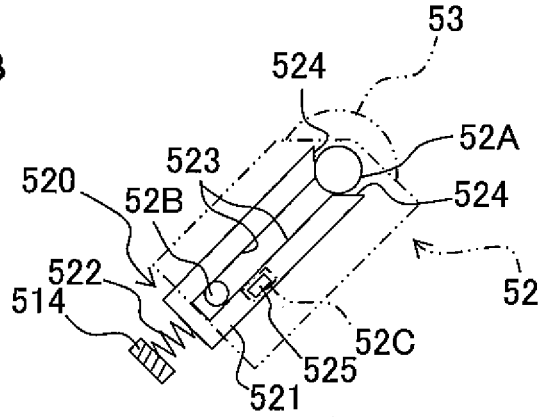

The guide member 521 is formed to have a substantially U-shape. An inner surface of the guide member 521 defines a pair of guide surfaces 523 configured to incline frontward and obliquely upwardly. As shown in FIGS. 4A and 4B, bosses 52B formed in each of the developing cartridges 52 are guided by the pair of guide surfaces 523. Each of the developing cartridges 52 is removable with respect to the support body 510 via the guide member 512. Here, a removing direction in which the developing cartridge 52 is removed from the guide member 521 (support body 510) is inclined obliquely upward toward the downstream of the pull-out direction of the support member 510.

With this, it is possible to perform the install/remove operation of the developing cartridge 52 easily as compared with a construction in which the developing cartridge is installed/removed in a vertical direction. Note that the bosses 52B protrude or project outwardly in the left/right direction from the left and right side walls respectively at lower portion of each of the developing cartridges 52, and the bosses 52B are formed to have a columnar shape of which diameter is smaller than the diameter of the axis portions 52A.

Further, a pair of end portions 524 located while sandwiching an opening of the U-shaped guide member 521 therebetween are formed to incline in a V-shaped manner with respect to the guide surfaces 523 toward the downstream of the install direction of the developing cartridge 52. With this, the pair of end portions 524 function as an axial support portion configured to support the axis portions 52A of the developing cartridge 52, as shown in FIG. 4B.

Furthermore, the guide member 521 is supported by an un-illustrated guide rib, etc. so that the guide member 521 is movable in the install/remove direction of the developing cartridge 52 (direction in which the photosensitive drum 51 and the developing roller 53 face each other). Moreover, the coil springs 522 are provided between the guide members 520 and the projections 514 of the support body 510.

Figure 4C:
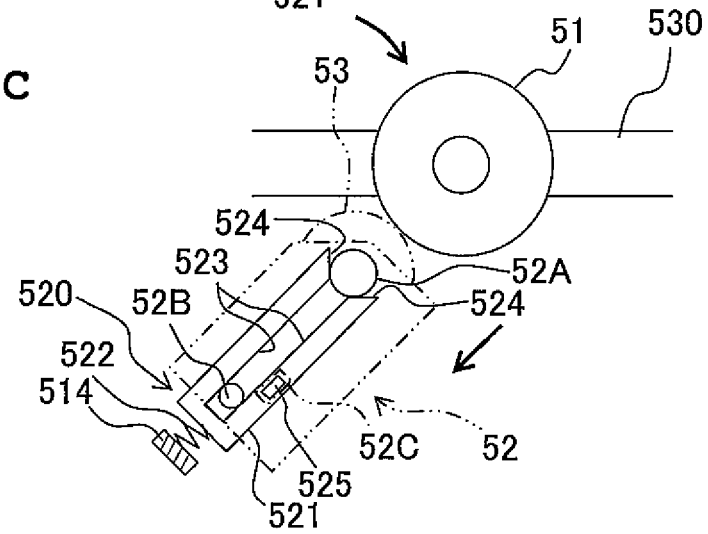

Accordingly, as shown in FIGS. 4A and 4B, the developing cartridge 52 is installed in the guide member 521 so that the developing roller 53 extends upwardly; and then as shown in FIG. 4C, when the developing roller 53 is pressed downwardly with the photosensitive drum 51, then the developing cartridge 52 and the guide member 521 are integrally moved rearward and obliquely downward, thereby compressing the coil spring 522. Then, the developing cartridge 52 is urged by the compressed coil spring 522 toward the photosensitive drum 51 via the guide member 521, thereby pressing the developing roller 53 against the photosensitive drum 51.

Further, a support body-side electrode 525, which makes contact with a cartridge-side electrode 52C provided on an outer surface of the developing cartridge 52, is provided on an inner surface of the guide member 521. By providing the support body-side electrode 525 on the guide member 521 configured to move together with the developing cartridge 52, even when for example the developing cartridge 52 and the guide member 521 are vibrated following the wobbling of the surface of the photosensitive drum 51 during printing, it is possible to prevent the respective electrodes 52C, 525 from being brought into contact slidably with each other, thereby preventing the respective electrodes 52C, 525 from being worn.

Note that the support member-side electrode 525 is connected to an un-illustrated control board provided on the apparatus body 10 via an un-illustrated harness, etc.

Figure 5A:
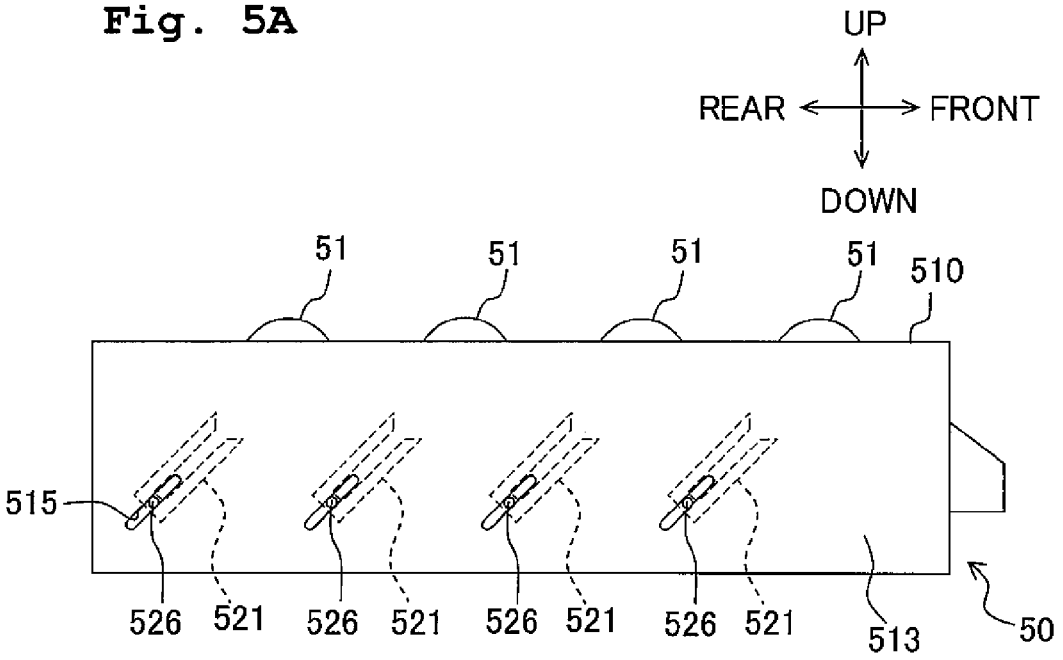
FIGS. 5A to 5C are explanatory views showing a relationship between a guide member and a separating mechanism.

Further, as shown in FIG. 5A, pins 526 projecting outwardly in the left/right direction are provided on surfaces (outer surfaces), of the guide member 521, on the outer side in the left/right direction. The pins 526 project outwardly through elongated holes 515 which are formed on the left and right side walls 513 of the support body 510. Note that the elongated holes 515 are formed to extend in the install/remove direction of the developing cartridges 52.

Figure 5B:
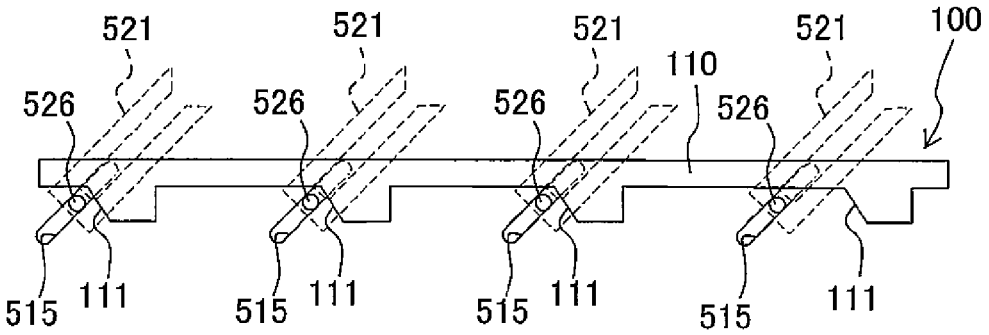
Figure 5C:
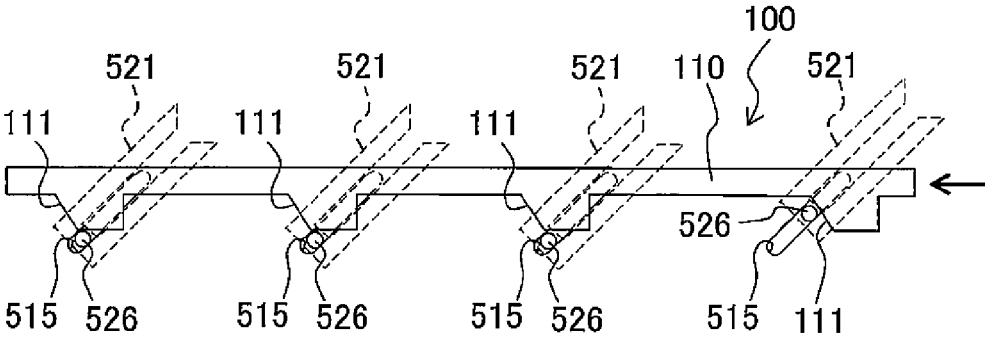

The pins 526 projecting outwardly through the support body 510 are configured to be movable along the elongated holes 515 by a separating mechanism 100 as shown in FIG. 5B. The separating mechanism 100 includes a separation cam 110 and an un-illustrated driving mechanism configured to move the separation cam 110 in the front/rear direction.

The separation cam 110 is an elongated translation cam extending in the front/rear direction (arrangement direction of the plurality of photosensitive drums 51); and the separation cam 110 moves rearward to thereby press and move the pins 526 rearward and obliquely downward. Specifically, the separation cam 110 is supported on the left and right side walls of the apparatus body 10 so that the separation cam 110 is movable in the front/rear direction.

Figure 6A:
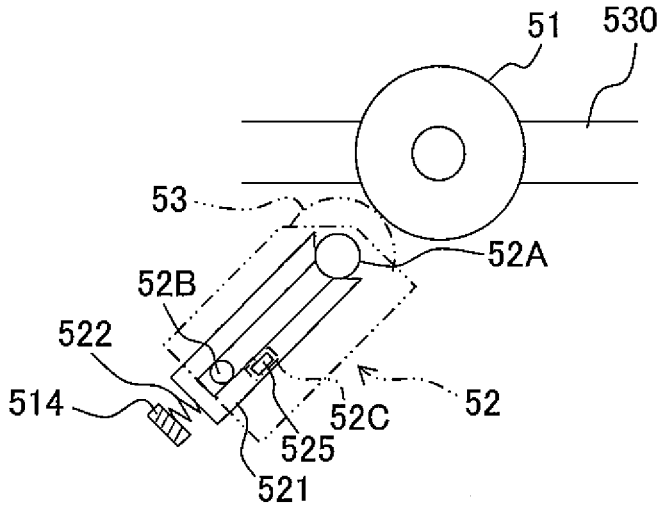
FIG. 6A is a an explanatory view showing a state that a developing roller is brought into contact with a photosensitive drum.
Figure 6B:
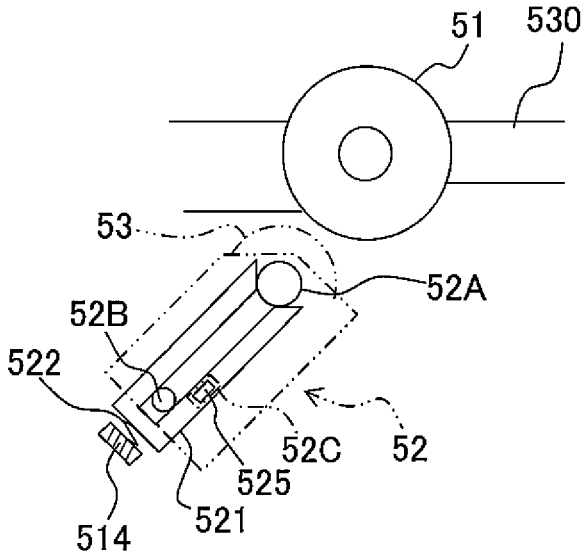
FIG. 6B is an explanatory view showing a state that the developing roller is separated away from the photosensitive drum.

The separation cam 110 has four cam surfaces 111 which are inclined with respect to the front/rear direction; and the separation cam 110 is configured to press the respective pins 526 by the four cam surfaces 111. With this, as shown in FIGS. 6A and 6B, the guide member 521 is separated away from each of the photosensitive drums 51 and the developing cartridge 52 is lowered by self-weight together with the guide member 521, thereby separating the developing rollers 53 away from the photosensitive drums 51, respectively.

Further, by appropriately separating the developing rollers 53 away from the photosensitive drums 51, respectively, it is possible, for example, to switch between color and monochrome modes. Note that as the un-illustrated driving mechanism configured to move the separation cam 110 in the front/rear direction, it is possible to adopt an appropriate driving mechanism such as a mechanism constructed of a motor, a gear, etc.; a mechanism configured to move the separation cam 110 in the front/rear direction interlocking with opening/closing of the front cover 14; and the like.

Furthermore, the drawer 50 is configured not to interfere with the separation cam 110 during the install/remove operation of the drawer 50. Specifically, when the drawer 50 is installed, the drawer 50 is firstly moved rearward by the un-illustrated rails and then is moved rearward and the obliquely upward. Therefore, the pins 526, each projecting outwardly through the drawer 50, are made to pass firstly below portions of the separation cam 110 at which the cam surfaces 111 are formed respectively, and then are moved to positions at which the pins 526 face the cam surfaces 111 respectively.

As shown in FIG. 3, the photosensitive body-support member 530 is supported on the support body 510 pivotably at rear upper portions of the left and right side walls 513. With this, when the developing cartridge(s) 52 is/are installed/removed, the photosensitive drums 51 can be retracted or withdrawn only by pivoting the photosensitive body-support member 530, thereby making it possible to easily perform the install/remove operation of the developing cartridge(s) 52 as compared with a construction wherein the photosensitive drums need to be removed from the support body every time the developing cartridge(s) is/are installed/removed.

Further, since the four photosensitive drums 51 are integrally supported by the photosensitive body-support member 530, the four photosensitive drums 51 can be retracted as a whole from the respective cartridges 52, and thus the install/remove operation for the developing cartridges 52 can be performed easily.

Furthermore, the photosensitive body-support member 530 is configured to be pivotable between a first posture (posture shown in FIG. 1) in which the photosensitive drums 51 are brought into contact with the developing rollers 53 respectively and a second posture (posture shown in FIG. 3) in which the photosensitive drums 51 are retracted maximally from the developing rollers 53 respectively. Namely, an unillustrated regulating portion, which is configured to regulate the pivot range of the photosensitive body-support member 530, is provided on the support body 510, and the photosensitive body-support member 530 is made pivotable between the first and second postures by the regulating portion.

Moreover, a rotation angle α defined between the first and second postures of the photosensitive body-support member 530 is set to be greater than an angle β defined by the removing direction of the developing cartridges 52 with respect to the photosensitive body-support member 530 when the photosensitive body-support member 530 assumes the first posture. In other words, the angle α defined by a straight line L1 connecting the pivot axis of the photosensitive body-support member 530 assuming the first posture with the rotation axes of the photosensitive drums 51 with respect to a straight line L2 connecting the pivot axis of the photosensitive body-support member 530 assuming the second posture with the rotation axes of the photosensitive drums 51 is set to be greater than the angle β defined by the removing direction of the developing cartridges 52 with respect to the straight line L1.

With this, it is possible to install and remove the developing cartridge(s) 52 without being interfered with respect to the photosensitive body-support member 530.

Note that the present teaching is not limited to the embodiment as described above, and is applicable in various forms or aspects as exemplified below. In the following explanation, a part or component which is substantially same as that of the above-described embodiment will be assigned with a same reference numeral as that of the embodiment, and the explanation therefore will be omitted.

Figure 7:
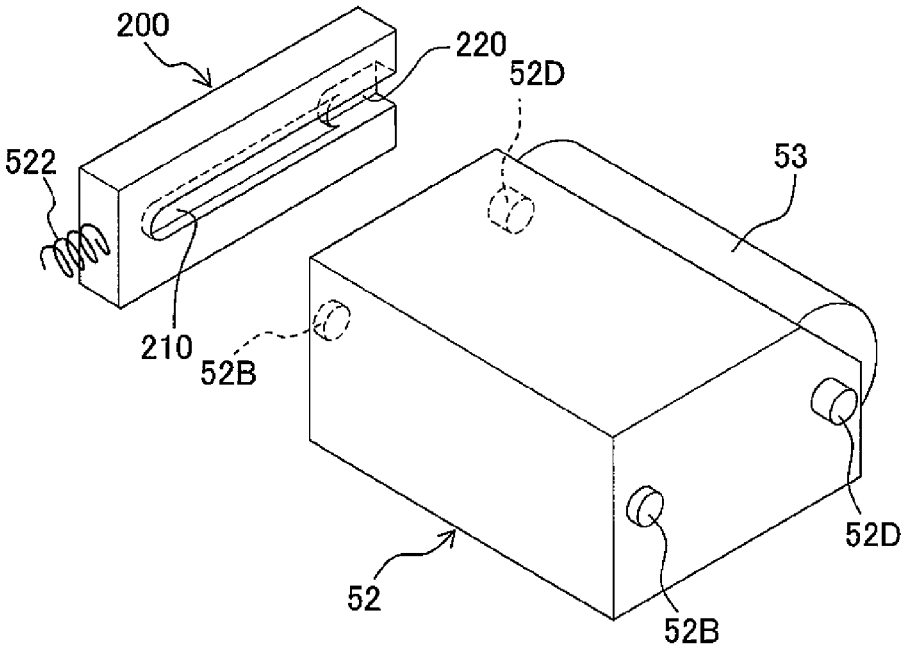
FIG. 7 is a perspective view of a modification of the guide member.

In the above embodiment, the axis portions 52A of each of the developing cartridges 52 are supported with the pair of end portions 524 of one of the U-shaped guide members 521. The present teaching, however, is not limited to this construction; and it is allowable that a U-shaped axial support groove 220 supports an axis portion 52D of a developing cartridge 52, as shown in FIG. 7. Specifically, in this construction, the axis portion 52D of the developing cartridge 52 is provided as axis portions 52D projecting or protruding outwardly in the left/right direction to an extent greater than bosses 52B, and the axis portions 52D are formed to have a columnar shape of which diameter is substantially same as the diameter of the bosses 52B.

A guide member 200 is formed to have a rectangular parallelepiped shape and is provided with a U-shaped guide groove 210 guiding the boss 52B of the developing cartridge 52 and the U-shaped axial support groove 220 formed in the guide groove 210 on the opening side thereof. The groove bottom surface of the U-shaped axial support groove 220 is extended outwardly to some extent in the left/right direction than the groove bottom surface of the guide groove 210. According to this construction, since the axis portion 52D is accommodated inside the U-shaped axial support groove 220, it is possible to obtain such an effect, in addition to the effect similarly to that obtained by the above-described embodiment, that the axis portion 52D is prevented in ensured manner from inadvertently or erroneously falling or detaching from the axial support groove 220 when the guide member 220 is moved by the separating mechanism 110.

Figure 8:
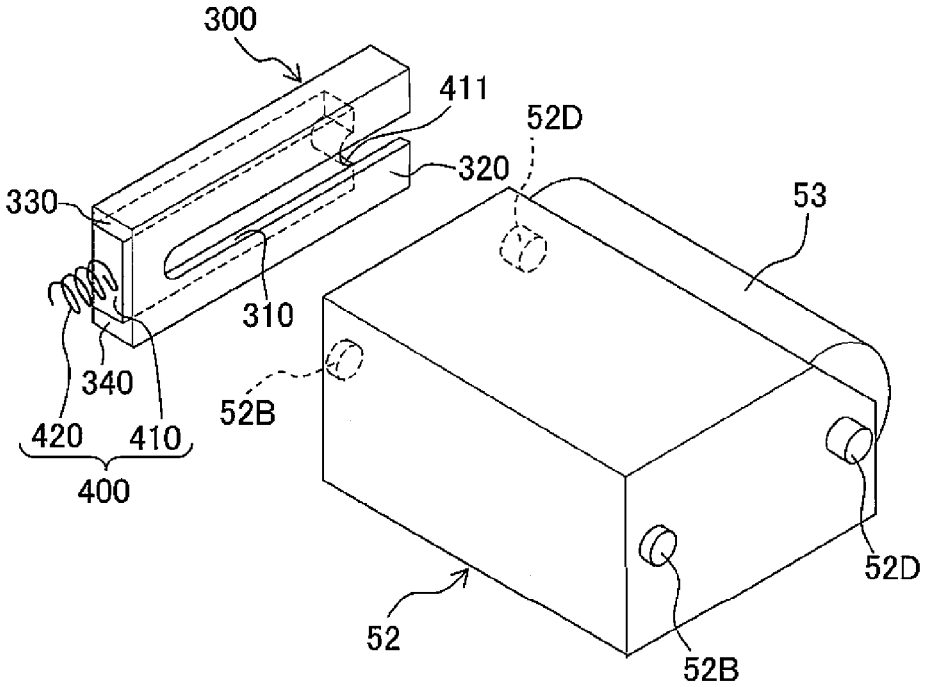
FIG. 8 is a perspective view of an aspect in which the guide member and an axial support portion are formed separately.

In the above-described embodiment, the pressing member 520 is constructed of the guide member 521 and the coil spring 522. Namely, the guide member 521 and the coil spring 522 are integrated to construct the pressing member 520. The present teaching, however, is not limited to such a construction; and it is allowable that the guide member and the pressing member are formed as separate members. For example, as shown in FIG. 8, it is allowable to form a pressing member 400 with a contact member 410 which is movable, in the install/remove direction of the developing cartridge 52, with respect to a guide member 300 fixed to the support body 510 (not shown in FIG. 8), and a coil spring 420 as an example of the urging member configured to urge the contact member 410 toward the photosensitive drum 51.

The guide member 300 is formed to have a substantially U-shaped form in sectional view and includes a body 320 in which a U-shaped slit 310 guiding a boss 52B of a developing cartridge 52 having a construction same as that shown in FIG. 7, and an upper wall portion 330 and a lower wall portion 340. The upper wall portion 330 and a lower wall portion 340 extend from upper and lower end portions, respectively of the body 320 outwardly in the left/right direction and are fixed to the support body 510 (not shown in FIG. 8).

The contact member 410 is configured to be slidable in the guide member 300 having the substantially U-shaped form in sectional view; and the contact member 410 has, on an end portion thereof on a side opposite to the coil spring 420, a semi-circular shaped axial support portion 411 configured to receive the axis portion 52D of the developing cartridge 52. As described above, also in a case that the axial support section 411 is formed as a separate body or member from the guide member 300, it is possible to press the axis portion 52D of the developing cartridge 52.

Note that, however, in a case that the guide member 521 and the axial support portion (the pair of end portions 524) are formed as an integrated body or member, it is possible to reduce the number of parts or components as compared with the case that the axial support portion and the guide member are formed as separate bodies.

Figure 9:
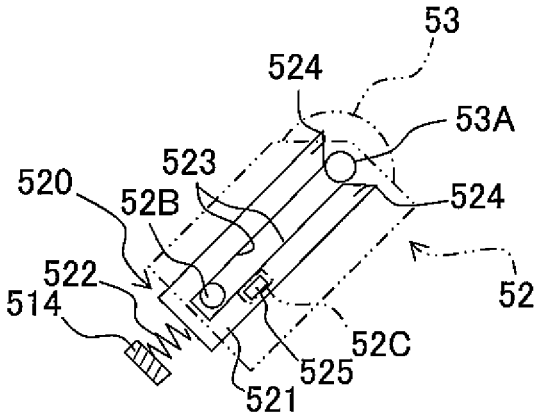
FIG. 9 shows an explanatory view corresponding to FIG. 4B in which the rotation shaft of the developing roller is pressed directly by the pressing member.

In the above-described embodiment, the axis portions 52A, which are coaxial with the rotation shaft of the developing roller 53, are pressed by the pressing member 520. However, the present teaching is not limited to such a configuration. It is not indispensable that the developing roller 53 includes the axis portions 52A. For example, as shown in FIG. 9, it is allowable to press the rotation shaft 53A of the developing roller 53 with the pressing member 520. As compared with the developing roller 53 as shown in FIG. 4B, instead of pressing the axis portions 52A configured to be coaxial with the rotation shaft 53A of the developing roller 53, the rotation shaft 53A of the developing roller 53 is directly pressed by the pressing member 520.

In the embodiment, the photosensitive body is exemplified by the photosensitive drum 51. However, the present teaching is not limited to this, and it is allowable to use, as the photosensitive body, for example a belt-shaped photosensitive body.

In the embodiment, the support body configured to removably support the developing cartridge is exemplified by the support body 510 configured to be movable with respect to the apparatus body 10. However, the present teaching is not limited to this, and it is allowable that the support body is, for example, a frame constructing the apparatus body.

In the embodiment, the present teaching is applied to the color printer 1. However, the present teaching is not limited to this, and it is allowable that the present teaching is applied to other image forming apparatuses, such as a monochrome printer, a copying machine, a multi-functional machines, etc. In the embodiment, the sheet is exemplified by the paper sheet S such as thick paper, postcard, thin paper, etc. However, the present teaching is not limited to this, and the sheet may be, for example, OHP sheet.

What is claimed is:

1. An image forming apparatus configured to form an image on a sheet-shaped medium, comprising:

a photosensitive body configured to receive formation of an electrostatic latent image thereon;

a developing cartridge arranged below the photosensitive body and having a developing roller configured to supply a developing agent to the photosensitive body and to be rotatable about a rotation shaft of the developing roller, the developing cartridge having a guided portion;

an apparatus body;

a support body configured to removably support the developing cartridge and to move between an extracted position at which the support body is extracted from the apparatus body and an accommodated position at which the support body is accommodated in the apparatus body, the support body being configured to accommodate the developing cartridge; and a biasing member configured to bias the rotation shaft of the developing roller so as to bias the developing roller toward the photosensitive body, the biasing member having a guiding portion configured to guide the guided portion of the developing cartridge in a guiding direction;

wherein the guided portion of the developing cartridge is separate from the rotation shaft of the developing roller, and wherein the biasing member is located in the support body, and is configured to bias the developing cartridge so that the developing cartridge is moved relative to the support body.

2. The image forming apparatus according to claim 1, wherein:

the rotation shaft of the developing roller has an axis portion, the axis portion being coaxial with the rotation shaft and projecting in an extending direction of the rotation shaft, and the biasing member is configured to bias the axis portion.

3. The image forming apparatus according to claim 1, wherein:

the guiding portion is configured to guide the developing cartridge to an install position, the guiding portion is supported by the support body to be movable in a facing direction in which the photosensitive body and the developing roller face each other, the guiding portion having an axial support portion configured to support the rotation shaft of the developing roller, and the biasing member is configured to bias the guiding portion toward the photosensitive body.

4. The image forming apparatus according to claim 3, wherein:

the developing cartridge has a cartridge-side electrode, and the guiding portion has a support body-side electrode configured to contact the cartridge-side electrode.

5. The image forming apparatus according to claim 3, wherein:

the guiding portion is formed to have a substantially U-shape, and includes a pair of guide portions extending substantially parallel to each other at a spacing distance, and a connection portion connecting the pair of guide portions, the axial support portion is formed at end portions, of the guide portions, on a side opposite to the connection portion, the developing cartridge has a substantially semi-cylindrical shaped boss projecting in an extending direction of the rotation shaft of the developing roller, and the boss of the developing cartridge is disposed between the pair of guide portions of the guiding portion so that the developing cartridge is guided by the guiding portion.

6. The image forming apparatus according to claim 1, wherein:

the guiding portion is configured to guide the developing cartridge to an install position, and the support body includes a contact member configured to be movable with respect to the guiding portion in a facing direction in which the photosensitive body and the developing roller face each other, the contact member configured to contact with the rotation shaft, and the biasing member is configured to bias the contact member toward the photosensitive body.

7. The image forming apparatus according to claim 1, further comprising an apparatus body in which a fixing device configured to thermally fix an image of the developing agent on the medium is located, wherein:

the photosensitive body and the developing cartridge include a plurality of photosensitive bodies and a plurality of developing cartridges, respectively, the support body is configured to be pulled out from the apparatus body in a pull-out direction, and the developing cartridge is removable with respect to the support body so that a removing direction in which the developing cartridges are removed from the support body extends in an inclined direction extending obliquely upwardly and toward downstream of the pull-out direction.

8. The image forming apparatus according to claim 7, wherein the support body has a photosensitive body-support member being pivotably provided on the support body and configured to support the plurality of photosensitive bodies.

9. The image forming apparatus according to claim 8, wherein the photosensitive body-support member is configured to be pivotable between a first posture in which each of the photosensitive bodies is brought into contact with the developing roller and a second posture in which each of the photosensitive bodies is refracted from the developing roller; and a rotation angle defined by the first and second postures of the photosensitive body-support member is set to be greater than an angle defined by the removing direction with respect to the photosensitive body-support member under a condition that the photosensitive body-support member assumes the first posture.

10. The image forming apparatus according to claim 1, further comprising a separating mechanism configured to separate the developing roller away from the photosensitive body, wherein the separating mechanism separates the biasing member away from the photosensitive body so as to separate the developing roller away from the photosensitive body while utilizing a self weight of the developing cartridge.

11. The image forming apparatus according to claim 1, wherein the guiding portion of the biasing member includes a positioning portion located at an end of the guiding portion and configured to position the shaft of the developing roller, and the guiding direction is inclined with respect to a horizontal direction.

* * * * *